US005269864A

United States Patent [19]

Otruba

[11] Patent Number: 5,269,864

[45] Date of Patent: Dec. 14, 1993

[54] HIGH SPEED LABELING MACHINE

[75] Inventor: Svatoboj Otruba, Ceres, Calif.

[73] Assignee: B & H Manufacturing Co., Inc., Ceres, Calif.

[21] Appl. No.: 504,579

[22] Filed: Apr. 4, 1990

[51] Int. Cl.[5] ..... B65C 3/16

[52] U.S. Cl. ..... 156/215; 156/448; 156/449; 156/458; 156/568; 156/DIG. 13; 156/DIG. 26

[58] Field of Search ..... 156/450, 458, DIG. 26, 156/448, 449, 542, 567, 568, DIG. 13, 556, 571, 215

[56] References Cited

U.S. PATENT DOCUMENTS 4,108,710 8/1978 Hoffmann ..... 156/458 X
4,500,386 2/1985 Hoffmann ..... 156/567 X
4,574,020 3/1986 Fosnaught ..... 156/450 X
4,714,515 12/1987 Hoffmann ..... 156/458 X
4,761,200 8/1988 Szeremeta ..... 156/448
4,931,122 6/1990 Mitchell ..... 156/458 X

*Primary Examiner*—David A. Simmons
*Assistant Examiner*—Mark A. Osele
*Attorney, Agent, or Firm*—Flehr, Hohbach, Test, Albritton & Herbert

[57] ABSTRACT

Machine and method for labeling cylindrical containers wherein a rotary vacuum drum transports the labels from a pick up station to a release station, containers are moved, in sequence, to said release station and into tangent contact with the leading end of a label on the vacuum drum, each container is held in contact with the label While the vacuum drum continues to rotate and meanwhile spinning the container oppositely to the rotation of the vacuum drum.

5 Claims, 2 Drawing Sheets

HIGH SPEED LABELING MACHINE

This invention relates to a labeling machine and a method of labeling capable of labeling containers at high speed.

FIELD OF THE INVENTION

The invention relates primarily to labeling cylindrical containers but has other applications such as wrapping protective sheet material about containers to withstand pressure and/or to render the containers impermeable to gases such as carbon dioxide in carbonated beverages and/or to be impermeable to atmospheric oxygen; wrapping protective and/or decorative sheets about other articles than containers; etc. For convenience, the invention will be described with reference to labeling cylindrical containers. The label material may be plastic, paper or plastic-paper laminates, etc.

BACKGROUND OF THE INVENTION

In labeling containers it is desirable to operate high speeds. In one type of labeling machine which has been successful, namely that of U.S. Pat. No. 4,500,386, if labeling is carried out at high speeds difficulties are encountered owing to the fact that the path of travel of the containers is S-shaped and undergoes an inflection at the junction of two circular paths having opposite curvature. At high speeds the change of direction at this point of inflection imposes strain on the machine and the containers. Also the machine of the '386 Patent employs a downstream guide or roll-on pad to hold the containers against the vacuum drum while the label is being wrapped. Containers of the same nominal size and shape frequently depart from the assumed or nominal size and shape, which may cause difficulties. Furthermore there is a need for precise registry of each container and the leading end of a label as the two come into tangent contact.

SUMMARY OF THE INVENTION

It is an object of the present invention to provide improvements in labeling machines and methods.

It is a particular object of the invention to provide a labeling machine and method which are capable of high speed labeling without the disadvantages, or with diminished disadvantages described above.

The above and other objects of the invention will be apparent from the ensuing description and the appended claims.

GENERAL DESCRIPTION OF THE INVENTION

The machine of the present invention employs a vacuum drum to apply labels to containers but moves the labels oppositely to the translatory motion of the containers while in contact with the labels and it spins the containers during such contact in the direction opposite to the direction of rotation of the label. The machine also applies a yielding, resilient force to the container during label application so that variations in shape and dimensions of the container are accommodated.

BRIEF DESCRIPTION OF THE DRAWINGS

One embodiment of the invention is shown by way of example in the accompanying drawings, in which:

Referring now to FIG. 1, the machine is generally designated by the reference numeral 10 and it comprises a rotary vacuum drum 11 rotated by a central axial shaft 12 and having sectors 13 which are arcs of the same circle. Between the two sectors 13 are sectors 14 which are a lesser distance from the shaft 12 than the sectors 13 and a higher sector 15 between the sectors 14. It will be understood, of course, that there may be only one sector 13 or that there may be three or more such sectors as desired. A label 16 is shown on one of the sectors 13.

Figure 1:
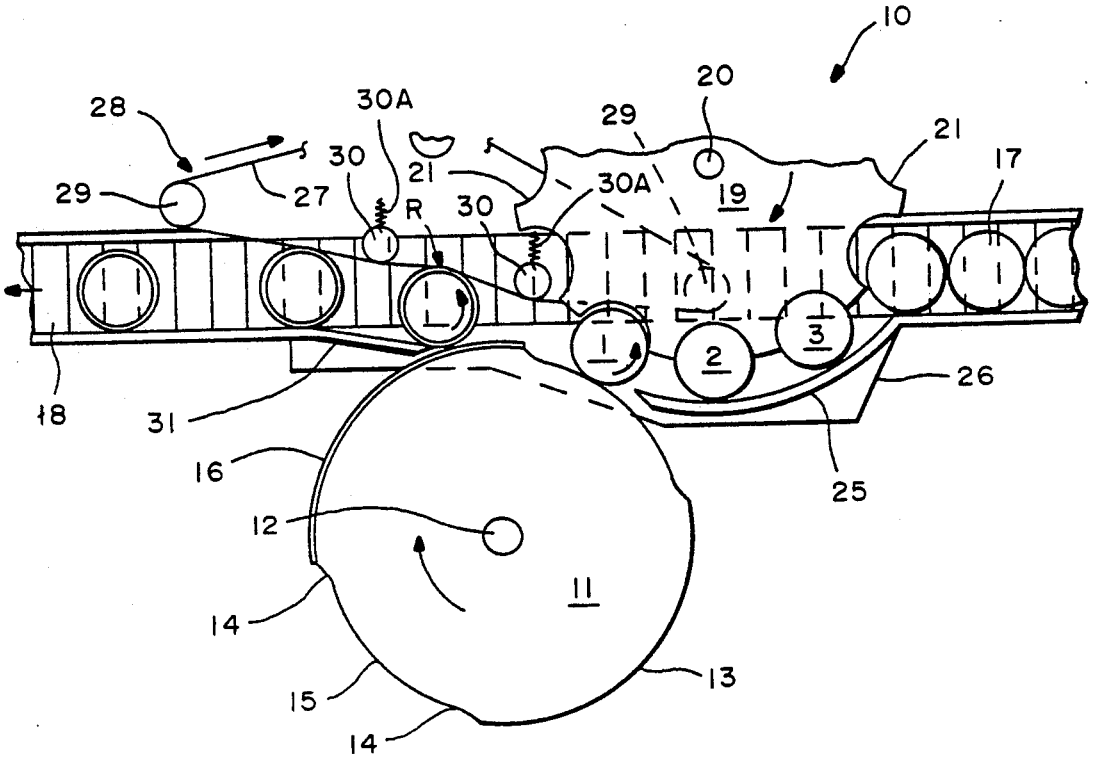
FIG. 1 is a diagrammatic plan view of a labeling machine shown at a time when the next container to be labeled is approaching the point of contact with the label and commencement of labeling.

It will be understood that, as described in U.S. Pat. Nos. 4,108,710 and 4,500,386 labels may be applied continuously to the continuously rotating vacuum drum 11 from a continuous strip of label material which is severed into individual labels; that each severed label is supplied, in its turn, to the drum 11 and is held on a sector 13 by vacuum; that glue is applied to the leading and trailing ends of each label on a sector 13 to adhere the leading end of the label to the container and to adhere the trailing end to the container in the case of "spot labeling" where the label is not wrapped completely around the container or to adhere the trailing end of the label to the leading end where the trailing end overlaps the leading end. It will also be understood that glue may be applied to the container to adhere the leading end of the label as described in U.S. Pat. No. 4,108,710 and that solvent may be applied to a plastic label to form an adhesive in situ. Also a stack feed of precut labels may be employed and the labels may have pressure sensitive or heat activatable adhesive applied to them.

Cylindrical containers are shown at 17 being conveyed from right to left by a continuous conveyor 18 which may be of conventional construction. Each container 17 is picked up by a star wheel 19 mounted on a shaft 20 and having pockets 21 to receive the containers. The star wheel 19 diverts the containers, which are held by the pockets 21 assisted by a curved guide 25, the containers being supported by a base or frame member 26.

In FIG. 1 of the drawings three of the containers are numbered No. 1, No. 2 and No. 3. In FIG. 1 container No. 1 has left guide 25 and is in contact with a sector 15 of the vacuum drum. The sector 15, which the container No. 1 is shown as just leaving, serves to smooth the transition of container No. 1 (and of successive containers) from the pockets 21 of the star wheel 18 and the guide 25.

Container No. 1 also contacts, or is about to contact, a flexible endless belt 27 of a belt system 28 which is driven in the direction of the arrows by one or the other of drive rolls 29 and is tensioned by floating idlers 30 which are suitably mounted and urged toward the vacuum drum and the containers by suitable springs indicated as 30A so that the belt 27 is maintained in contact with the containers up to the point of release indicated as R. The containers are guided back onto the conveyor 17 by a discharge guide 31.

Figure 2:
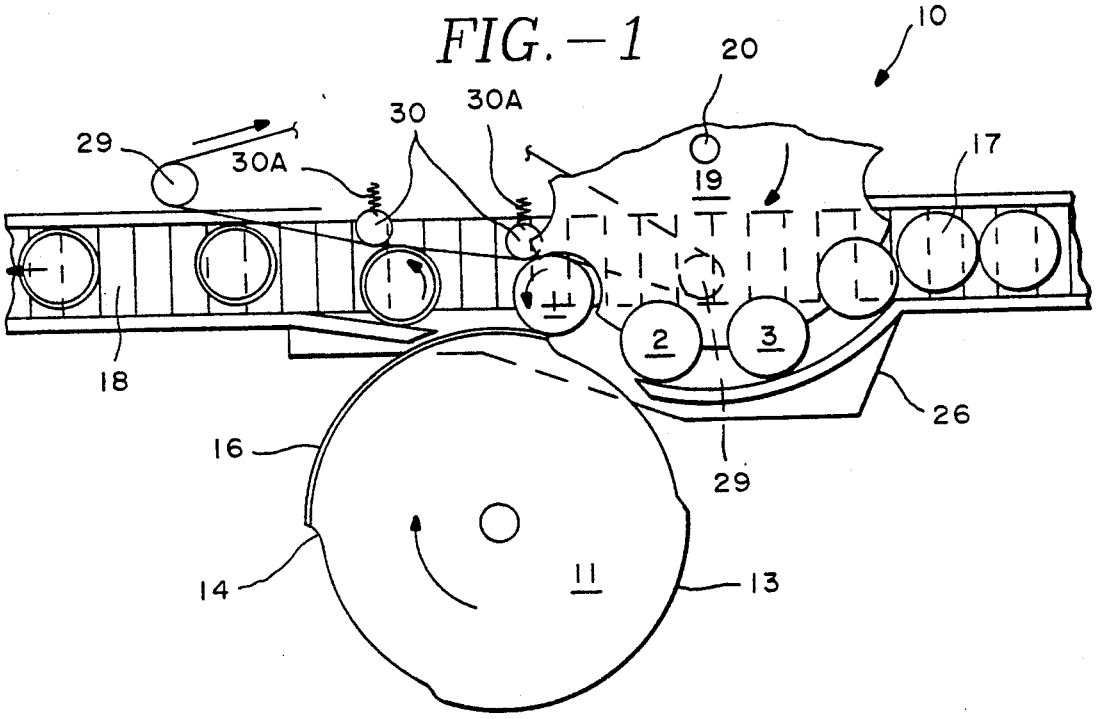
FIG. 2 is identical to FIG. 1 but shows the aforesaid label at the commencement of labeling.

In FIG. 2 container No. 1 is shown at the instant it contacts the leading end of a label 16 on the vacuum drum 11 at the leading of a sector 13 and at the moment of release from the star wheel 19. Container No 1 is being spun about its axis in counterclockwise direction (as viewed in FIGS. 1 to 4) while the label is still on the vacuum drum 11 and is moving in clockwise direction.

Figure 3:
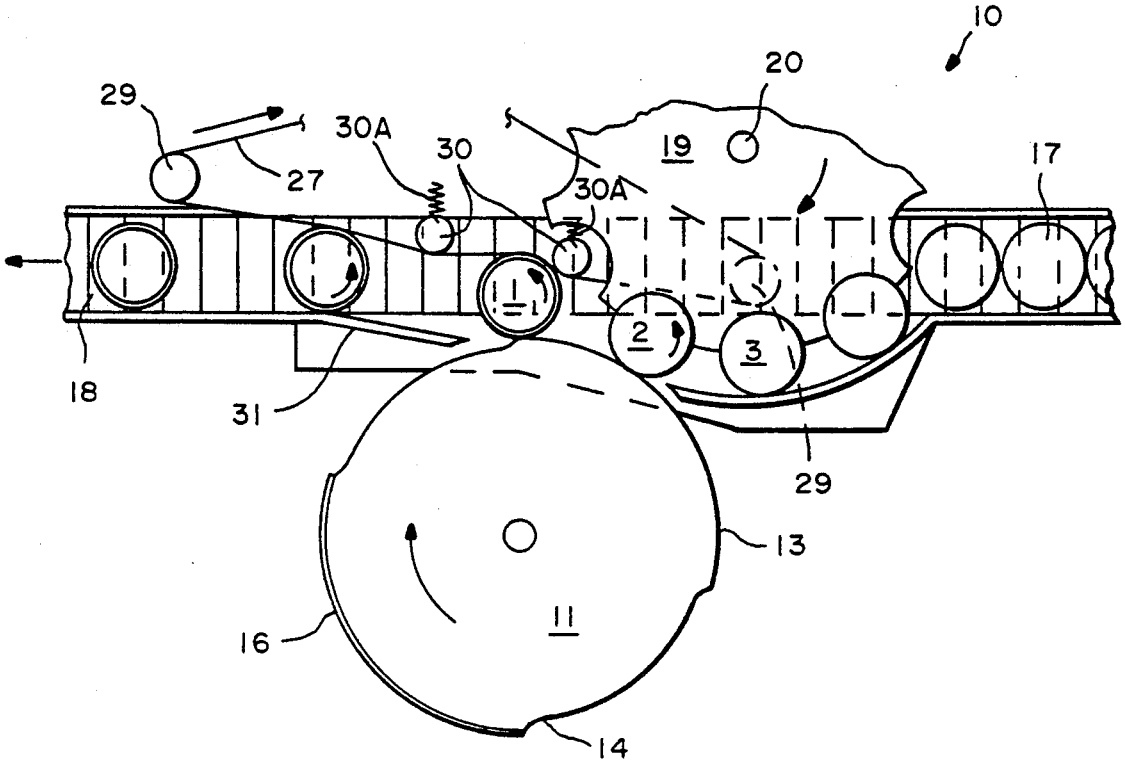
FIG. 3 shows the machine at the end of labeling a container and with the container about to leave contact with the labeling drum.

In FIG. 3 the trailing end of the portion of sector 13 has reached container No. 1 which has meanwhile been translated by the star wheel 19 and the belt 27 to the position shown. During this very brief period of time the container No. 1 has been spun about its axis and has wrapped a label 16 about itself. This accomplishes labeling without the need of a roll-on pad, as described above, without any change of direction between paths of opposite curvature and without leaving a loose end flagging. Also precise synchronism of the label and the container are not required.

Figure 4:
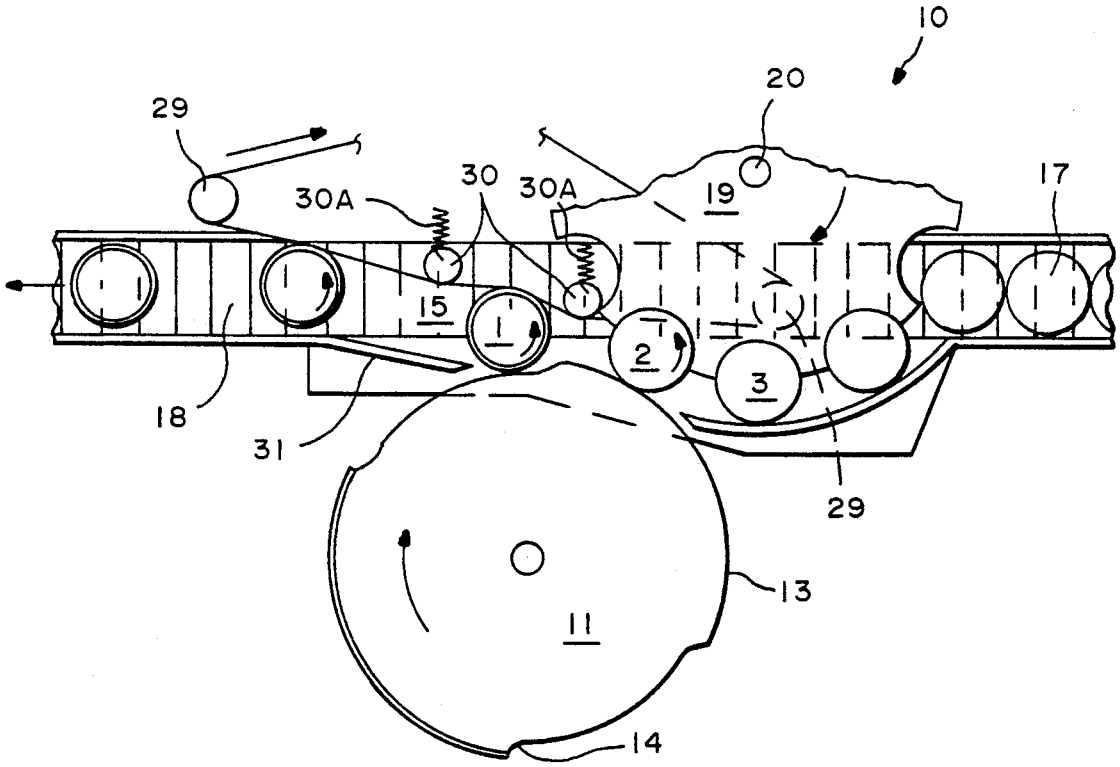
FIG. 4 shows the machine with a labeled container having left the vacuum drum.

Referring to FIG. 4 the completely labeled container No. 1 has left its sector 13, is located in a sector 15 and is about to be picked up by guide 31 and guided back on to the conveyor 18.

It will therefore be apparent that a new and advantageous machine and method of labeling have been provided.

I claim:

1. A machine for wrapping segments of sheet material, each having a leading end and a trailing end, about the cylinder surfaces of cylindrical articles comprising:

(a) a rotary vacuum drum rotatable about a central drum axis and having on its periphery at least one sector capable of receiving such segments in sequence at a segment delivery station, rotating each segment to a segment release station, and releasing each segment at such segment release station, said sector being a cylindrical arc centered on said drum axis, (b) a star wheel article feed having pockets and rotatable about an axis parallel to said drum axis and capable of picking up in its pockets said articles in sequence at an article pickup station, holding each article in a pocket, and rotating each article so held from said article pickup station about the star wheel axis in the same rotary direction as the rotation of the vacuum drum and in a path which is an arc of a circle centered on the star wheel axis, such rotation serving to bring each article, in turn, into initial tangent contact with the leading end of a segment on a sector on the vacuum drum at the segment release station and then to release the article at an article release station, and (c) guide means for thereafter guiding the released article with a segment attached to it along a curved path in generally the same direction that the article travelled at the time of said initial tangent contact while maintaining tangent contact of the article with the segment on the sector and without an abrupt change of direction, and (d) spinning means for spinning each article about its cylinder axis from at least the time of such tangent contact until the wrap has been completed, said spinning being opposite to the rotation of the vacuum drum.

2. The machine of claim 1 in which a moving belt moving in the same direction as the articles serves to hold the article in tangent contact with a segment on said sector after release of the article by the star wheel and until the segment wrap has been completed, said moving belt serving as said guide means (c) and said spinning means (d).

3. The machine of any of claims 1 and 2 in which there is a section on the surface of said vacuum drum in advance of each said sector which serves to retain each article in a pocket of the star wheel until the article contacts the leading end of a sector.

4. A method of wrapping segments of sheet material, each having a leading end and a trailing end, about the cylinder surfaces of cylindrical articles which comprises:

(a) providing a vacuum drum rotatable about a central drum axis and having on its periphery at least one sector capable of receiving such segments in sequence at a segment delivery station, rotating each segment to a segment release station, and releasing each segment at such segment release station, said sector being a cylindrical arc centered on said drum axis, (b) providing also a star wheel article feed having pockets and rotatable about an axis parallel to said drum axis and capable of picking up in its pockets said articles in sequence at an article pickup station, holding each article in a pocket, and rotating each article so held from said article pickup station about the star wheel axis in the same rotary direction as the rotation of the vacuum drum and in a path which is an arc of a circle centered on the star wheel axis, such rotation serving to bring each article, in turn, into initial tangent contact with the leading end of a segment on a sector on the vacuum drum at the segment release station and then to release the article at an article release station, and (c) supplying such segments to said sector or sectors in sequence while the vacuum drum is rotating, such that as the vacuum drum rotates the leading end of each segment is brought to said segment release station followed by the remainder of said segment, (d) meanwhile operating said star wheel to bring each container, in sequence, into tangent contact with the leading end of a segment on the vacuum drum at said segment release station, and thereafter releasing such container, (e) then continuing movement of said container in the same general direction without an abrupt change in direction meanwhile maintaining tangent contact with said segment on said sector and spinning the container to accomplish wrapping of the segment about the article.

5. The method of claim 4 wherein said continuous movement and spinning of the containers are accomplished by a moving belt which serves to move and spin the containers.

* * * * *